US008277705B2

(12) United States Patent
Stolarczyk et al.

(10) Patent No.: US 8,277,705 B2
(45) Date of Patent: Oct. 2, 2012

(54) RESTORING DAMAGED RAIL SEATS LOCATED ON CONCRETE RAIL TIES

(75) Inventors: Craig B. Stolarczyk, Eugene, OR (US); Robert M. Loomis, Eugene, OR (US); Paul D. Rogers, Eugene, OR (US); Omar Tiba, Eugene, OR (US)

(73) Assignee: Willamette Valley Company, Eugene, OR (US)

( * ) Notice: Subject to any disclaimer, the term of this patent is extended or adjusted under 35 U.S.C. 154(b) by 524 days.

(21) Appl. No.: 10/598,379

(22) PCT Filed: Mar. 24, 2005

(86) PCT No.: PCT/US2005/010066

§ 371 (c)(1),
(2), (4) Date: Aug. 25, 2006

(87) PCT Pub. No.: WO2005/095107

PCT Pub. Date: Oct. 13, 2005

(65) Prior Publication Data

US 2008/0235929 A1 Oct. 2, 2008

Related U.S. Application Data

(60) Provisional application No. 60/556,209, filed on Mar. 24, 2004.

(51) Int. Cl.
*B29C 73/00* (2006.01)

(52) U.S. Cl. ..... 264/36.22; 264/35; 264/36.18

(58) Field of Classification Search ..... 264/35, 264/36.18, 36.22
See application file for complete search history.

(56) References Cited

U.S. PATENT DOCUMENTS

| | | | | | |
|---|---|---|---|---|---|
| 4,275,172 | A | * | 6/1981 | Barth et al. | 521/112 |
| 4,295,259 | A | * | 10/1981 | Rhodes et al. | 29/402.18 |
| 4,716,210 | A | | 12/1987 | Trummelmeyer et al. | |
| 5,166,303 | A | * | 11/1992 | Markusch et al. | 528/26 |
| 5,173,222 | A | * | 12/1992 | Young et al. | 264/35 |
| 5,405,081 | A | | 4/1995 | Bosshart | |
| 5,607,998 | A | * | 3/1997 | Markusch et al. | 524/494 |
| 6,786,680 | B2 | * | 9/2004 | Markusch et al. | 405/270 |
| 7,138,437 | B2 | * | 11/2006 | Giorgini et al. | 521/101 |

FOREIGN PATENT DOCUMENTS

FR 2734848 5/1995

OTHER PUBLICATIONS

Azom.com Article (Polyurethanes—What goes into Pus?) (2003) see http://web.archive.org/web/20031105183005/http://www.azom.com/details.asp?ArticleID=218.*

* cited by examiner

*Primary Examiner* — Yogendra Gupta
*Assistant Examiner* — Amjad Abraham
(74) *Attorney, Agent, or Firm* — Marger Johnson & McCollom, P.C.

(57) ABSTRACT

A method for restoring a damaged rail seat located on a concrete rail tie. The method comprises applying a polymeric material comprising a poly(urethane-urea) material to the damaged rail seat located on the concrete rail tie; and restoring the damaged rail seat by curing the polymeric material under ambient temperature and pressure conditions. The polymeric material is substantially sag resistant and maintains its shape without substantial runoff from the concrete rail tie during the restoring of the damage rail seat.

24 Claims, No Drawings

RESTORING DAMAGED RAIL SEATS LOCATED ON CONCRETE RAIL TIES

BACKGROUND

This invention is directed to methods and materials for restoring damaged rail seats located on concrete rail ties.

Conventionally, rails are held to rail ties by rail clips or fasteners that bear down on the rail flange. A rail seat insulates the rail from the rail ties. The rail seat can be fabricated of an elastomeric material such as rubber, polyurethane, ethyl vinyl acetate or high-density polyethylene U.S. Pat. No. 5,173,222 ("US '222"), which is incorporated herein by reference, relates to a method and apparatus for repairing damaged concrete rail ties. Concrete rail ties have been found to be prone to wear particularly in sandy and wet locations or on steep grades where the locomotives use sand for traction. US '222 explains the cause of this wear. US '222 provides a method and apparatus for repairing rail tie damage utilizing an abrasion resistant composition and an abrasion plate as described therein.

As shown in the drawings of US '222, a rail seat 4 is disposed on a rail tie 1. The tie 1 is surrounded by ballast 2. The rail seat 4 is defined by the edges of the rail tie 1 and the rail clamp shoulders 3, which are embedded in the concrete tie 1 and adapted to hold the rail clamps (not shown) that bear down on the flange of the rail (not shown). The damaged rail seat is repaired by filling the worn recess 5 with a rail seat epoxy composition. An abrasion plate 6 (also referred to as an attenuating pad) can be bonded to the repaired rail seat.

US '222 identifies two problems. First, abraded rail ties need to be repaired quickly enough to limit hold up of train traffic to an acceptable time. Second, badly abraded rail seats need to be restored to their original dimensions.

The paste of US '222 employs an abrasion resistant material and a curable epoxy resin material. This epoxy resin is used for repairing damaged rail seats and also for reducing further abrasion. However, even when applied in a relatively thin layer, the cure time can take 12 to 36 hours at typical ambient temperatures. This is completely unacceptable from a train operator's point of view.

If the trains are running even slowly over the freshly repaired rail seats, and if the epoxy is still in a plastic state, it will run-off. This will disrupt the true level of the rail seat, causing cavities to form in the rail seat material. This results in improper bonding to the abrasion plate. All of these factors will lead to subsequent failure of the rail seat.

US '222 attempts to overcome these problems by providing a method of repairing a rail tie comprising applying an abrasion resistant composition which includes a curable epoxy binder to the eroded area of the rail tie, pressing the composition into place, and then heating the applied composition for a period sufficient to cure the epoxy binder. The rail plate can be placed on to the rail seat over the area to be repaired so that it becomes bonded using the epoxy binder repair composition to the rail tie with the application of heat and pressure using the hot box device 10 described in detail in US '222.

SUMMARY

It has now been determined that when epoxy resins are used to repair a rail tie seat a number of problems will result. Conducting the rail tie repair using heat and pressure is a problem since this restoration method is difficult to perform in the field by laborers who are not trained for this polymeric material pose. Curing an epoxy resin over a wide range of humidity's, temperatures and pressures is difficult to implement. Therefore, forming an effective rail tie seat in a commercial time frame is hard to consistently accomplish. Pre-catalyzed mercaptan-based epoxy hardeners are commonly required in epoxy formulations. It is difficult for these products to cure under cold climatic conditions. These mercaptan-based hardeners also have a very obnoxious odor and workers often complain of becoming nauseous when working with these products. Repairing a rail tie with an epoxy resin does not result in a refurbished product wherein superior performance under dynamic operating condition can be maintained. The use of an epoxy resin does not result in a rail tie that exhibits a high level of durability under load so that maintaining the gauge of a rail assembly is a problem. The use of an epoxy resin does not result in a rail tie that exhibits a high level of fracture resistance under load so that maintaining the gauge of a rail assembly cannot be accomplished. The high viscosity of the epoxy resin makes handling more complicated when it is dispensed, particularly in the field.

It has now been determined regarding the present invention that when the polymeric materials of the present invention which comprise, and preferably consist essentially of, poly (urethane-urea) polymers, are employed to repair a rail tie seat, a number of advantages will result. More specifically, a method is provided for restoring a damaged rail seat located on a concrete rail tie. The method comprises applying a polymeric material comprising the poly(urethane-urea) material to the damaged rail seat located on the concrete rail tie. Then, the polymeric material is cured and the damaged rail seat is restored under ambient temperature conditions, preferably as low as about 45 degrees F., and under ambient pressure conditions. The poly(urethane-urea) material is substantially sag resistant and exhibits excellent pseudoplasticity. Thus, the poly(urethane-urea) material can maintain its shape during the rail seat restoration operation.

In the method the damaged rail seat is preferably restored without requiring the use of non-ambient heat. This will occur under the above-described temperature conditions. Furthermore, the damaged rail seat is preferably restored without requiring the use of non-ambient pressure. Accordingly, the subject restoration method is more easily performed in the field by laborers who are employed for this purpose.

The rail seat restored according to this invention has an extremely short Gel Time. Preferably, the gel time of the polymeric material is not more than about five seconds, more preferably not more than about three seconds, and most preferably not more than about one second. This allows for placement and retention of the rail seat components on the repair site without substantial run-off of the polymeric material from the repair site. In other words, the damaged rail seat and the poly(urethane-urea) material can be maintained in a fixed position on the surface of the concrete rail tie during the course of the rail seat restoration procedure.

The Set Time of the polymeric material can also be sufficient to permit contouring of the rail seat in situ in the repair area using application techniques that do not require the use of auxiliary heating sources such as trace lines or the like. Again, this is preferably done under ambient temperature conditions, preferably as low as about 45 degrees F., and under ambient pressure conditions. Preferably, the Set Time of the polymeric material is sufficient for contouring the restored rail seat without requiring the use of non-ambient heat and/or non-ambient pressure. Set Time is typically dependent upon temperature conditions and the thickness of applied polymeric material. Auxiliary heating is generally not required if the thickness of the applied polymeric material is between about ¼" up to about 1".

Another enhanced performance property for the polymeric materials of this invention is Shore D (24 hr.) Hardness. Thus, the Shore D (24 hr.) Hardness of the subject polymeric material is preferably at least about 65, more preferably at least about 70, and most preferably at least about 75.

The preferred rail tie properties can be maintained at a wide range of ambient temperatures during use. These ambient temperature are preferably up to at least about 120° F., more preferably to at least about 140° F., and most preferably up to at least about 160° F., and as low as −50° F., more preferably as low as about −25° F., and most preferably as low as about 0° F.

In the method of this invention, curing of the polymeric material during repair of the rail seat can be accomplished over a wide range of humidity's, temperatures and pressures. Therefore, an effective rail tie seat can be produced in a commercial time frame.

There is no obnoxious odor emitted with the subject polymeric material. Thus, a worker in the field does not have to deal with odor problems which plague prior art rail seat repair products.

Repairing a rail tie seat with the subject polymeric material results in a refurbished product wherein superior performance under dynamic operating conditions is maintained so that a high level of durability under load can be provided while maintaining the gauge of a rail assembly. The modulus of the polymeric material rail seat is also preferably increased to a level which will resist compressive loading and maintain the rail gauge of the rail assembly.

The polymeric material displays a high degree of toughness and ductility. Material toughness is indicated by area under stress-strain curve developed during tensile testing. Toughness-ductility classifications depend on the Elastic Modulus (Young's Modulus), tensile strength, and elongation. Rigid materials have an Elastic Modulus (E) that is defined as E>700 Mpa. Brittle materials have an elongation less than 10%, in the case of epoxy materials an elongation of about 5%. Ductile materials have an elongation as defined below of at least about 10% or higher. The subject polymeric material has an elongation as defined below which is preferably at 10% or higher. The subject polymeric material also has a modules that is in the rigid class of materials, a greater area under the stress strain curve, a substantial plastic energy of deformation term, and a lower filler loading that is enhanced by excellent bonding of the polymer matrix to the filler, minimizing internal defects and the size of the internal defect. Typical epoxy systems are highly filled and have nominal matrix-filler bonding resulting in numerous internal defects of considerable size.

The restored rail seat forms a rail tie, which preferably exhibits a high level of fracture resistance under load while maintaining the gauge of a rail assembly. This improved fracture resistance is evidenced by the presence of a higher level of mechanical properties, better SEM image analysis results, and an enhanced Griffith fracture analysis. Moreover, the tensile strength of the polymeric material rail seat is generally at least equivalent to epoxy resins used conventionally.

The percent elongation value of the restored rail seat is preferably increased to a level that results exhibit brittle fracture morphology. The restored rail seat preferably provides an increased percent elongation value that result in substantially improved material durability. Verification of the structural differences in durability of conventional epoxy resins and the subject polymeric material can by established by, for example, comparing the elongation ("Elongation") of each of the respective materials under tensile loading (ASTM D 638). Typically, conventional epoxy polymers show poor elongation properties (Elongation>5%) and exhibit a corresponding brittle fracture morphology. Contrarily, the Elongation of the polymeric material employed herein is preferably at least about 10%, more preferably at least about 15%, and most preferably at least about 20%.

The lowered viscosity of the subject polymeric material makes handling less complicated when it is dispensed, particularly in the field.

DETAILED DESCRIPTION

Polymeric materials comprising a poly(urethane-urea) that is particularly useful in this invention are prepared from various combinations of amine-terminated and hydroxyl-terminated resins that are reacted with an isocyanate material. These poly(urethane-urea) materials generally comprise at least one polyol compound, at least one amine compound, and an isocyanate.

The poly(urethane-urea) is formed employing (a) at least one polyol compound, typically a hydroxyl capped polyol and/or a hydroxyl chain extender, in a preferred amount from about 20%, more preferably from about 25%, and most preferably from about 30%, preferably up to about 60%, more preferably up to about 55%, and most preferably up to about 45%, (b) at least one amine compound, typically an amine capped polyether and/or an amine chain extender, in a preferred amount from about 0.5%, more preferably from about 1.0%, and most preferably from about 1.5%, preferably up to about 20%, more preferably up to about 15%, and most preferably up to about 10%, and (c) an isocyanate compound, typically an isocyanate prepolymer, in a preferred amount from about 20%, more preferably from about 25%, and most preferably from about 30%, preferably up to about 45%, more preferably up to about 40%, and most preferably up to about 35%.

Typical polyol compounds are hydroxyl capped di,tri-functional polypropylene oxides, hydroxyl capped di,tri-functional polyethylene oxides, hydroxyl capped di,tri-functional poly(propylene-ethylene)oxides, hydroxyl capped di-tri-functional polyesters. Examples of polyols which can be employed herein are Bayer LHT-240, Arch 20-280, Dow Voranol 230-238, and BASF Quadrol.

Typical amine compounds are di-tri-polyoxypropylenediamines, liquid aromatic diamines, isophronediamine, and diethylenetriamine. Examples of amines which can be employed herein are Shell Epi-Cure 3271, Huntsman D-230, and Dorf Ketal Unilink 4100.

Typical isocyanate compounds are di,tri-functional aromatic isocyanates, polymeric modified 4,4-diphenylmethane diisocyanates, and 1,6-hexamethylene diisocyanates (aliphatic isocyanates). Examples of isocyanates which can be employed herein are Bayer Desmodure N 3400, ICI Rubinate 1209, Bayer Mondur ML, Bayer Mondur MR.

The poly(urethane-urea) reactions can include a catalyst system to accelerate the reaction between the isocyanate and the hydroxyl groups of each polyol. Catalysts can be utilized in the system of this invention for accelerating the subject poly(urethane-urea) formation reactions. These catalysts can include tin, mercury, lead, bismuth, zinc and various amine compounds such as are described in U.S. Pat. No. 5,011,902, which is incorporated herein in its entirety by reference. A preferred catalyst employed herein is a metal carboxylate.

In certain instances it may be desirable to add a chain extender to complete the formulation of poly(urethane-urea) polymers by reacting isocyanate groups of adducts or prepolymers. Examples of some types of polyol and amine chain extenders include 1,3-butanediol, 1,4 butanediol, 2-ethyl-1, 3-hexanediol, diethylene glycol, trimethylol propane and hydroquinone di(beta hydroxyethyl ether). The subject poly (urethane-urea) compositions may additionally incorporate diluents, fillers, compatibilizers, thixotropes, pigments and anti settling agents. Suitable fillers include barium sulfate, calcium sulfate, calcium carbonate, silica, and clay particles, such as aluminum silicates, magnesium silicates, ceramic and glass micro-spheres and kaolin. Suitable compatibilizers are hydroxy containing organic compounds, preferably hydroxy containing monocyclic arenes such as ethoxylated nonyl phenol, which compatibilize the polyol and aromatic diisocyanate reactants in the formulation. Suitable diluents include hydrotreated paraffinic oils, phthlates, carbonates, hydrotreated naphthenic oils, petroleum solvents, aliphatic solvents and propylene carbonate.

Equipment for dispensing the isocyanate and polyol(s)/amines employed in producing the poly(urethane-urea) material, such as the Mixus™ dispensing equipment manufactured by Willamette Valley Company of Eugene, Oreg., is commercially available. Typically, the two components which form the subject polyurethane filler material are pumped from storage tanks to a proportioning unit where the components are measured out according to a specified ratio. A known amount of each material is then separately pumped to a dispensing unit. The components are mixed in the dispensing unit and then introduced into the spike hole of the railroad tie.

A preferred polymeric material formulation and method of production which can be employed in this invention, and which was the polymeric material in the adhesion testing shown in Table 1, is as follows:

TABLE 1

| Material Name | Description | Type | Wt. % |
|---|---|---|---|
| LHT-240 | 700 MW polyether tri-functional polyol | polyol | 26.53% |
| 30-56/LG-56 | 3000 MW polyether tri-functional polyol | polyol | 13.22% |
| PPG-425 | 424 MW polyether diol | polyol | 12.62% |
| Vestamine IPD | Isophorone diamine | chain extender | 1.67% |
| EPI-Cure 3271 | Diethylene triamine | chain extender | 0.41% |
| 2-Ethyl-1,3-Hexanediol | 2-Ethyl-1,3-Hexanediol | chain extender | 7.80% |
| Butyl Benzyl Phthalate | Butyl Benzyl Phthalate | plasticizer | 4.37% |
| BYK-066N | BYK-066N | defoamer | 0.50% |
| | Methylene diisocyanate | diiocyanate | 32% including fillers |
| | Mix at 750 RPM for 10 minutes while adding: | | |
| Aerosil 200 | WACKER HDK 20 fumed silica | rheological modifier | 2.07% |
| | Mix at 1100 RPM for 20 minutes while adding: | | |
| MICRONA 7 | MICRONA 7 | calcium carbonate filler | 28.02% |
| POLYMERIC MATERIALMOL | | | |
| 3ST SIEVE | Molecular sieve | water absorbant | 2.56% |
| WV-90-S | WV-90-S | metal carboxylate catalyst | 0.14% |
| WV-50-S | WV-50-S | metal carboxylate catalyst | 0.08% |
| | Totals: | | 100.00% |

The Elongation of the polymeric material of Table 1 above is about 25%. In summary, the SEM and Elongation data clearly shows that the polymeric material is significantly superior for restoring damaged rails seats for use on concrete rail ties.

TABLE 2

Summary of Adhesion Testing-Mode of Failure (%)

| | Pull force(psi) | Concrete | Cohesive | Adhesive |
|---|---|---|---|---|
| Epoxy on a dry concrete block | 233 | 81 | 19 | 0 |
| Epoxy on a wet concrete block | 60 | 9 | 3 | 88 |
| Polymeric material (Table 1) on a dry concrete block | 400 | 100 | 0 | 0 |
| Polymeric material (Table 1) on a wet concrete block | 107 | 0 | 100 | 0 |

Table 2 compares the modes of ultimate failure of a conventional epoxy resin as adhered to dry and wet concrete, compared to the polymeric material of Table 1 as adhered to dry and wet concrete.

Table 2 shows the resistant of these polymeric materials to being pulled off of a wet and a dry concrete surface. The subject polymeric material exhibited a 71.7% in Pull Force on dry concrete and a 78.3% increase in Pull Force on wet concrete than a conventional epoxy material.

Each of the polymeric samples were inspected after being pulled from the wet and dry concrete block as provided in Table 2 above. A determination was then made as to where the failure occurred, and the extent of the failure with respect to the concrete block and polymer material. In the best situation, i.e., concrete bonding, all of the failure would occur in the concrete block and the detached polymeric material sample would have 100% concrete adhered thereto. In the next best situation, i.e., cohesive bonding, none of the detached polymeric material remains bonded to the concrete block and has any concrete material bonded to it. In the worse situation, i.e., adhesive bonding, a portion of the polymeric material sample would have been adhered to the concrete block. Thus, as evidence by the above data, the polymeric material of the present invention has better adhesion than the epoxy material (on both wet and dry concrete). Neither of the subject polymeric material samples showed any adhesive bonding with respect to either wet or dry concrete. The subject polymeric material sample showed no cohesive or adhesive bonding with respect to dry concrete. On the other hand, the epoxy material had a 19% and 3% cohesive bonding for dry and wet concrete, respectively, and an 88% adhesive bonding for wet concrete.

Certain differences between the subject polymeric material and the traditional epoxy based materials that are designed for the repair of abraded concrete rail-seats have been made by examining the mechanical data, Griffith fracture criteria, performance criteria, and SEM imaging. More specifically, SEM imaging is used to establish the local defect size for the performance of Griffith fracture strength calculations. In a visual analysis of the polymeric material of this invention and epoxy materials, respectively, the direct evaluation of fracture modes was made using a JOEL 6400 field emission scanning electron microscope. A prototype for the above-described polymeric material was compared to a typical epoxy material using cryogenic fracture techniques. Analysis of the materials was performed in accordance with the descriptions of fracture modes in the text *Polymer Microscopy* (Second Edition; Sawyer and Grubb) contained in Chapter Four—Specimen Preparation Methods. Specifically, section 4.8 of that text contains detailed descriptions and images of various yielding and fracture modes.

The polymeric material of this invention was visually determined to be intact with only a few yielding points and shear bands as depicted by the lines running vertically through the image. The polymer matrix is intact and several filler particles can be seen firmly imbedded in the matrix. In contrast, a typical epoxy material was visually determined to have a polymer matrix which has been shattered. The matrix was not intact and numerous fracture zones were observed. The image was filled with jagged fracture peaks that contribute to a rather busy image.

With cryogenic fracture, the worst case scenario of material failure is explored. In the case of the polymeric material, the matrix is capable of yielding without rampant cracking, thus contributing to higher fracture strengths. The epoxy material is incapable of yielding and it can be predicted that applied stress applied cyclically will eventually degrade that material. Failure analysis can be further compared using the techniques of Reifsnider and Case, *Damage Tolerance and Durability of Material Systems*.

The invention claimed is:

1. A method for restoring a damaged rail seat located on a concrete rail tie, which comprises providing said concrete rail tie, said damaged rail seat being located on the upper surface of said concrete rail tie;

applying an uncured polymeric material comprising a substantially sag resistant poly (urethane-urea) material, having excellent pseudoplasticity, to the damaged rail seat located on the upper surface of said concrete rail tie, said uncured, sag resistant poly(urethane-urea) material being maintained in a fixed position on the damaged rail seat without substantial runoff therefrom during restoring of the damaged rail seat, said sag resistant uncured poly (urethane-urea) material comprising, without the addition of water to the uncured poly(urethane-urea) material, (a) at least one polyol compound, (b) at least one amine compound, (c) an isocyanate compound, and (d) a chain extender which reacts with said isocyanate compound to form said substantially sag resistant poly (urethane-urea) material, said chain extender comprising (i) at least one amine chain extender and/or (ii) at least one hydroxyl chain extender;

prior to forming said restored cured rail seat, contouring the sag resistant uncured polymeric material applied to said damaged rail seat on the upper surface of the concrete rail tie in situ to form a sag resistant contoured damaged rail seat having substantially the original dimensions of an undamaged rail seat, the sag resistant contoured damaged rail seat being substantially contourable and maintaining its shape without substantial runoff from the concrete rail tie during said contouring of the uncured polymeric material; and curing the contoured damaged rail seat under ambient temperature and pressure conditions to form a restored cured rail seat, the uncured polymeric material of said sag resistant contoured damaged rail seat being substantially contourable and maintaining its shape without substantial runoff from the concrete rail tie during said restoration operation, wherein when the damaged rail seat located on the concrete rail ties is restored, the restored rail seat is properly bondable to an abrasion plate and maintains the gauge of a rail assembly under dynamic operating conditions.

2. The method of claim 1, wherein the damage rail seat is restored without requiring the use of non-ambient heat.

3. The method of claim 1, wherein the damage rail seat is restored without requiring the use of non-ambient pressure.

4. The method of claim 1, wherein the Gel Time of the polymeric material is not more than about five seconds.

5. The method of claim 1, wherein the Gel Time of the polymeric material is not more than about one second.

6. The method of claim 1, wherein the Set Time of the polymeric material is sufficient for contouring the polymeric material applied to the damaged rail seat in situ so that the contoured polymeric material can maintain said shape without runoff during the rail seat restoration operation.

7. The method of claim 1, wherein the polymeric material is cured at a temperature as low as 45° F.

8. The method of claim 1, wherein the modulus of the restored rail seat is increased to a level which will resist compressive loading and maintain the rail gauge of the rail assembly.

9. The method of claim 1, wherein the Elongation of the polymeric material is at least about 10% or higher.

10. The method of claim 1, wherein the Shore D (24 hour) Hardness of the restored rail seat is at least about 65.

11. A method for restoring a damaged rail seat located on a concrete rail tie, which comprises providing said concrete rail tie, said damaged rail seat being located on the upper surface of said concrete rail tie;

applying an uncured polymeric material comprising a substantially sag resistant poly(urethane-urea) material, having excellent pseudoplasticity, to the damaged rail seat located on the upper surface of said concrete rail tie, said uncured, sag resistant poly(urethane-urea) material being maintained in a fixed position on the damaged rail seat without substantial runoff therefrom during restoring of the damaged rail seat, said sag resistant uncured poly(urethane-urea) material comprising, without the addition of water to the uncured poly(urethane-urea) material, (a) at least one polyol compound, (b) at least one amine compound, (c) an isocyanate compound, and (d) a chain extender which reacts with said isocyanate compound to form said substantially sag resistant poly (urethane-urea) material, said chain extender comprising (i) at least one amine chain extender and/or (ii) at least one hydroxyl chain extender;

prior to forming said restored cured rail seat, contouring the sag resistant uncured polymeric material applied to said damaged rail seat on the upper surface of the concrete rail tie in situ to form a sag resistant contoured damaged rail seat having substantially the original dimensions of an undamaged rail seat, the sag resistant contoured damaged rail seat being substantially contourable and maintaining its shape without substantial runoff from the concrete rail tie during said contouring of the uncured polymeric material; and curing the contoured damaged rail seat under ambient temperature and pressure conditions to form a restored cured rail seat, the uncured polymeric material of said sag resistant contoured damaged rail seat being substantially contourable and maintaining its shape without substantial runoff from the concrete rail tie during said restoration operation, wherein when the damaged rail seat located on the concrete rail ties is restored, the restored rail seat is properly bondable to an abrasion plate and has a modulus which is increased to a level which will resist compressive loading and maintain the rail gauge of a rail assembly.

12. The method of claim 11, wherein the damage rail seat is restored without requiring the use of non-ambient heat.

13. The method of claim 11, wherein the damage rail seat is restored without requiring the use of non-ambient pressure.

14. The method of claim 11, wherein the Gel Time of the polymeric material is not more than about five seconds.

15. The method of claim 11, wherein the Gel Time of the polymeric material is not more than about one second.

16. The method of claim 11, wherein the Set Time of the polymeric material is sufficient for contouring the polymeric material applied to the damaged rail seat in situ so that the contoured polymeric material can maintain said shape without runoff during the rail seat restoration operation.

17. The method of claim 11, wherein the rail ties having the restored rail seat maintains the gauge of a rail assembly under dynamic operating conditions.

18. The method of claim 11, wherein the polymeric material is cured at a temperature as low as 45° F.

19. The method of claim 11, wherein the Elongation of the polymeric material is at least about 10% or higher.

20. The method of claim 11, wherein the Shore D (24 hour) Hardness of the restored rail seat is at least about 65.

21. A method for restoring a damaged rail seat located on a concrete rail tie, which comprises providing said concrete rail tie, said damaged rail seat being located on the upper surface of said concrete rail tie;

applying an uncured polymeric material comprising a substantially sag resistant poly(urethane-urea) material, having excellent pseudoplasticity, to the damaged rail seat located on the upper surface of said concrete rail tie, said sag resistant uncured poly (urethane-urea) material being maintained in a fixed position on the damaged rail seat without substantial runoff therefrom during restoring of the damaged rail seat, said sag resistant uncured poly(urethane-urea) material comprising, without the addition of water to the uncured poly(urethane-urea) material, (a) at least one polyol compound, (b) at least one amine compound, (c) an isocyanate compound, and (d) a chain extender which reacts with said isocyanate compound to form said substantially sag resistant poly (urethane-urea) material, said chain extender comprising (i) at least one amine chain extender and/or (ii) at least one hydroxyl chain extender;

prior to forming said restored cured rail seat, contouring the sag resistant uncured polymeric material applied to said damaged rail seat on the upper surface of the concrete rail tie in situ to form a sag resistant contoured damaged rail seat having substantially the original dimensions of an undamaged rail seat, the sag resistant contoured damaged rail seat being substantially sag resistant contourable and maintaining its shape without substantial runoff from the concrete rail tie during said contouring of the uncured polymeric material; and curing the contoured damaged rail seat under ambient temperature and pressure conditions to form a restored cured rail seat, the uncured polymeric material of said sag resistant contoured damaged rail seat being substantially contourable and maintaining its shape without substantial runoff from the concrete rail tie during said restoration operation, wherein when the damaged rail seat located on the concrete rail ties is restored, the restored rail seat maintains the gauge of a rail assembly under dynamic operating conditions, and is properly bondable to an abrasion plate, and has a modulus which is increased to a level which will resist compressive loading and maintain the rail gauge of a rail assembly.

22. The method of claim 1, wherein hydroxyl chain extender is a diol and/or a triol and said amine chain extender is a diamine and/or a triamine.

23. The method of claim 11, wherein said hydroxyl chain extender is a diol and/or a triol and said amine chain extender is a diamine and/or a triamine.

24. The method of claim 21, wherein said hydroxyl chain extender is a diol and/or a triol and said amine chain extender is a diamine and/or a triamine.

* * * * *

UNITED STATES PATENT AND TRADEMARK OFFICE

CERTIFICATE OF CORRECTION

PATENT NO. : 8,277,705 B2
APPLICATION NO. : 10/598379
DATED : October 2, 2012
INVENTOR(S) : Craig B. Stolarczyk et al.

It is certified that error appears in the above-identified patent and that said Letters Patent is hereby corrected as shown below:

Claim 21, Column 10, lines 13-14, delete “sag resistant”;

Claim 22, Column 10, line 30, after “wherein” insert --said--.

Signed and Sealed this
Twentieth Day of November, 2012

David J. Kappos

David J. Kappos
*Director of the United States Patent and Trademark Office*